US005108033A

United States Patent [19]

Schuh

[11] Patent Number: 5,108,033

[45] Date of Patent: Apr. 28, 1992

[54] SPINNER NOZZLE ASSEMBLY FOR CYLINDER DIAGNOSIS

[75] Inventor: David N. Schuh, Calgary, Canada

[73] Assignee: Beta Machinery Analysis Ltd., Calgary, Canada

[21] Appl. No.: 287,445

[22] Filed: Dec. 20, 1988

[30] Foreign Application Priority Data

Nov. 30, 1988 [CA] Canada ..... 584632

[51] Int. Cl.[5] ..... B05B 3/04

[52] U.S. Cl. ..... 239/1; 239/214; 239/251

[58] Field of Search ..... 239/251, 1, 259, 5, 239/261, 250, 263, 223, 214; 73/47, 120

[56] References Cited

U.S. PATENT DOCUMENTS

| | | | |
|---|---|---|---|
| 2,091,024 | 8/1937 | Beshers | 73/47 |
| 2,212,466 | 8/1940 | Bradford | 73/47 |
| 2,236,960 | 3/1942 | Graham | 239/261 |
| 2,526,265 | 10/1950 | Nulph | 239/251 |
| 3,104,672 | 9/1963 | Holdren . | |
| 3,125,297 | 3/1964 | Copeland et al. | 239/261 |
| 3,809,317 | 5/1974 | Bender | 239/251 |
| 3,814,330 | 6/1974 | Masters . | |
| 4,030,513 | 6/1977 | McKenzie | 239/251 |
| 4,164,325 | 8/1979 | Watson | 239/252 |
| 4,677,997 | 7/1987 | Strauss | 134/167 |

FOREIGN PATENT DOCUMENTS 1073945 3/1980 Canada .

*Primary Examiner*—Andres Kashnikow
*Assistant Examiner*—Kevin P. Weldon
*Attorney, Agent, or Firm*—John Russell Uren

[57] ABSTRACT

A nozzle assembly used for assisting in the diagnosis of cylinder condition. The nozzle assembly emits oil normal to the axis of the assembly about a 360 degree arc such that the cyclinder walls are more completely wetted with oil prior to diagnostic tests occuring such as leakage or flow rate and compression checks. A spinning nozzle provides enhanced oil emission.

7 Claims, 2 Drawing Sheets

SPINNER NOZZLE ASSEMBLY FOR CYLINDER DIAGNOSIS

INTRODUCTION

This invention relates to a nozzle assembly for emitting oil prior to the testing of a cylinder and, more particularly, to a nozzle assembly which emits oil normal to the axis of the nozzle assembly and the cylinder bore axis utilising a spinning nozzle.

BACKGROUND OF THE INVENTION

Reciprocating engines are frequently tested in order to determine the condition of their cylinders. Leakage or flow rating is one technique used for such testing while compression testing is a further technique. If the cylinder being tested meets specifications for such testing, the cylinder is assumed to be in good condition. If the cylinder does not meet specifications, it is assumed that replacement of the piston rings, valves, piston or cylinder is necessary.

In testing using flow rating techniques, the cylinder is tested under both "dry" and "wet" conditions. That is, the cylinder is initially tested by applying a pressure to the cylinder and determining the flow rate of air which is required to hold this pressure. Subsequently, the cylinder walls are "wetted" with oil and the test is again conducted. Such testing can also involve detection of leakage at either the exhaust or intake valves or at the air start valves by ultrasonic techniques. If the leakage is reduced under "wet" conditions, the individual conducting the cylinder diagnosis can be reasonably confide that it is the rings that are defective. If no reduction occurs under wet conditions, then it is reasonably concluded that the valves are at fault.

The wet test described involves the insertion of an oil nozzle into the cylinder through the spark plug hole and emitting oil from the nozzle in order to attempt to form a seal between the piston rings and the cylinder wall with the oil. Following the insertion of the oil, the leakage test is again performed to determine the quantity of air required to maintain the predetermined pressure. If the quantity of air required is substantially less than initially required, it may reasonably be assumed the piston rings are defective in that cylinder.

There are, however, problems with existing "wet" techniques. The oil nozzle used emits oil only directly outwardly from the nozzle and coaxial with it. This may result in an uneven coating of oil on the cylinder walls. In using such a nozzle assembly, therefore, there is an added uncertainty in the results of the subsequent leakage tests and, therefore, the results may not give an accurate portrayal of actual cylinder conditions.

SUMMARY OF THE INVENTION

According to one aspect of the invention, there is disclosed a nozzle assembly comprising a body portion, liquid access means for allowing liquid access to said body portion, a spinner portion mounted on said body portion and being rotatable about an axis and liquid emitting holes in said spinner portion extending normal to said axis.

According to a further aspect of the invention there is disclosed a method of wetting the wall of a cylinder comprising inserting a nozzle assembly through an access hole into said cylinder, providing oil under pressure to said nozzle assembly, and emitting oil from said nozzle assembly through a spinner means in a direction substantially normal to the axis of said spinner means about substantially 360 degrees.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
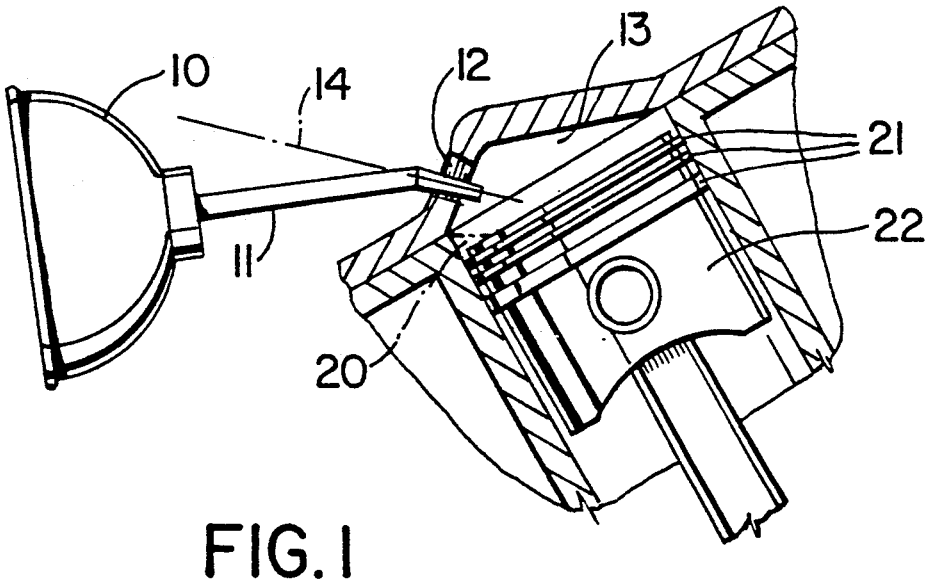
FIG. 1 is a view of the existing prior art technique for wetting cylinder walls prior to compression testing.

Reference is initially made to FIG. 1 wherein a view of the current practice used in cylinder wetting for cylinder testing purposes is given. An oil source such as an oil can 10 has a tapered nozzle 11 extending therefrom which is inserted through a spark plug hole 12 into a cylinder 13, the spark plug having been previously removed to allow the cylinder test to take place. A flow rate or "leakage" test has previously been performed with the cylinder under "dry" conditions and a value for the flow rate required for the cylinder 13 under "dry" conditions has been taken.

Oil is subsequently squirted from oil can 10 through nozzle 11 into cylinder 13. The oil, however, is emitted by nozzle 11 in a direction coaxial with the axis 14 of the end of the nozzle 11 in the direction indicated by the arrow. While it is possible to aim the end of the nozzle 11 at various parts of the cylinder 13, some areas within the cylinder may simply not receive any oil because of the configuration of the cylinder 13 and the restricted movement of the oil can 10. Further, if the engine is one that uses cylinders which slant, such as is usually the case in V-type engine configurations, the oil emitted by the nozzle 11 will accumulate in the lowest portion of the cylinder as at 20 in FIG. 1.

In using this technique, therefore, the oil does not act to seal the piston rings 21 of the piston 22 totally around their circumference. This can affect the subsequent readings when the flow rate or leakage is performed and, therefore, the integrity of the test results are somewhat suspect.

Figure 5:
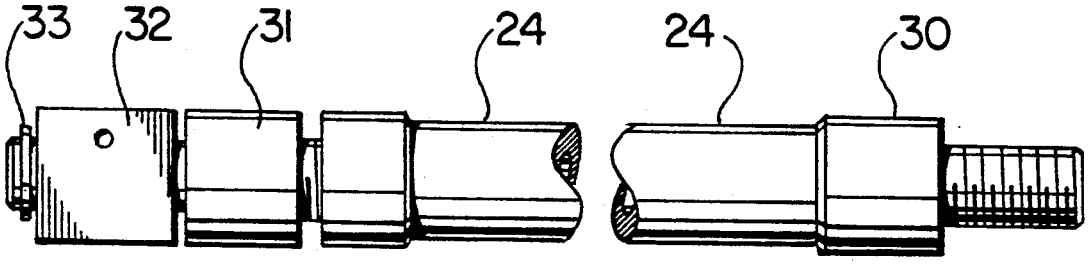
FIG. 5 is an enlarged assembly view of the body and spinner portion in the nozzle.

Reference is now made to FIG. 5 wherein a nozzle assembly according to the invention is illustrated generally at 23. The assembly 23 comprises a flexible supply tube 24 connected on one end to a threaded male fitting 30 which is adapted to be inserted into a complementary female fitting (not shown) which is connected to the oil source, such oil being provided under pressure as will be described in more detail hereafter. A body portion 31 is connected to the supply tube 24 and a spinner portion 32 is mounted on the body portion 31, the spinner portion 32 rotating relative to the body portion 31 about an axis 51. A snap ring 33 fits into a groove 34 (FIG. 3) and retains the spinner portion 32 on the body portion 31.

Figure 3:
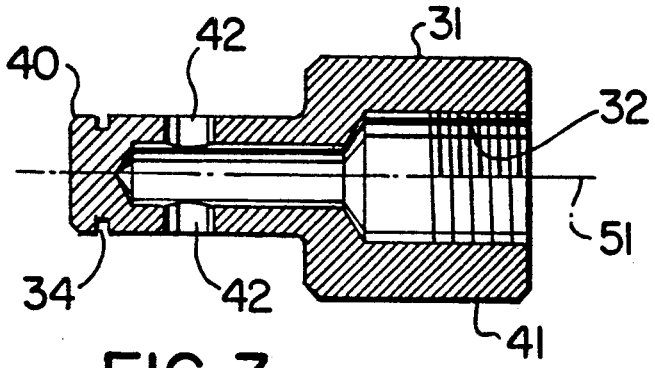
FIG. 3 is an enlarged sectional side view of the body portion of the nozzle assembly.

The body portion 31 is shown more clearly in FIG. 3. It comprises a threaded end 32 on a base 41 which is adapted to have a threaded connection on the supply tube 24. An elongate extension 40 extends from the base 41 and is adapted to allow rotation of the spinner portion 32. Two relatively large holes 42 are positioned in the extension 40, one on each side of the extension 40. A groove 34 for snap ring 33 is mounted on the outer end of extension 40 as earlier described.

Figure 4A:
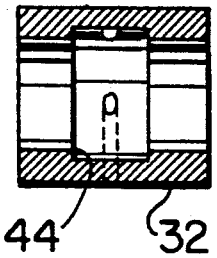
FIGS. 4A and 4B are enlarged sectional side and front views of the spinner portion of the nozzle assembly.
Figure 4B:
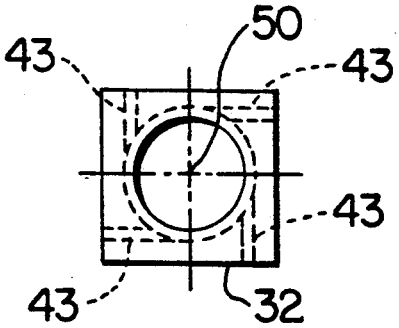

The spinner portion 32 is illustrated more clearly in FIGS. 4A and 4B. The spinner portion 32 has an inside diameter which is of a size suitable to allow the spinner 32 to be mounted and rotate on extension 40. Four holes 43 are drilled through the side of the spinner 32, one in each side as illustrated. The holes 43 are drilled off the centre of rotation 50 of the spinner portion 32 so as to emit oil and cause the spinner portion 32 to turn when oil is emitted. A cavity 44 is located in the spinner 32 and acts to receive the oil which flows through holes 42 in extension 40.

OPERATION

In operation, it will be assumed that the tube 24 is mounted to the male fitting 30. The body portion 31 is then mounted on the tube 24 and the spinner portion 32 is mounted on the extension 40. Snap ring 33 is then mounted in groove 33.

Figure 2:
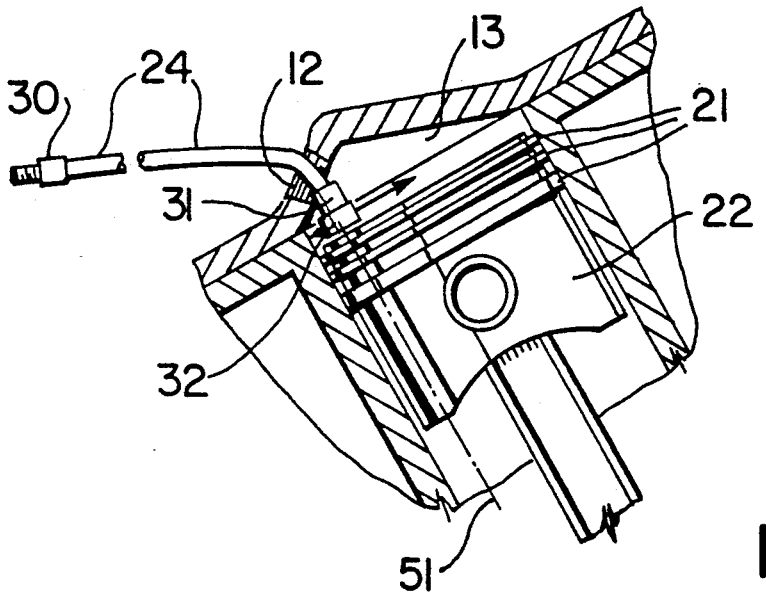
FIG. 2 is a diagrammatic isometric view of the oil nozzle and cylinder wetting technique according to the invention.

Referring to FIG. 2, the male fitting 30 is connected to an oil source under pressure (not shown) and oil is provided to the body portion 31 through tube 24. The oil flows through holes 42 and into the cavity 44 of the spinner portion 32. The oil, being under pressure, will be forced through the holes 43 in the spinner 32 which will cause the spinner 32 to rotate and emit oil from the holes 43 in a 360 degree configuration around the axis 50 of the spinner 32 as illustrated by the drawings. The walls of cylinder 13 will be wetted in a much improved manner with more ease than is the case with the prior art method and apparatus of FIG. 1. Hence, subsequent test readings will be obtained which are more accurate than those obtained with the prior art technique and, therefore, engine diagnosis can be made with greater confidence.

An oil source such as an oil filled grease gun has been found to be satisfactory with oil provided to the nozzle at a pressure of approximately 400 p.s.i. For cylinder testing of ordinary gasoline engines, an inside diameter for the body portion 31 of about 5/64 inch has been found to be satisfactory with the outside diameter of the extension being approximately 0.124 inch. The diameter of holes 42 in extension 40 are 1/16 inch. The inside diameter of the spinner 32 of 0.125 inch has been found satisfactory with appropriate tolerances for allowing free rotation. The holes 43 in spinner 32 have a diameter of 1/64 inch. Of course, for use with larger or smaller engines, the dimensions may change considerably depending on the application to which the nozzle 23 is made according to the invention. The supply tube 24 is made from ⅛ inch copper tubing which provides the necessary flexibility and permits the axis 51 of the spinner portion 52 to be located parallel to the axis of cylinder 13. The pressure required for flow rating with the nozzle assembly 23 is approximately 20 p.s.i.

To prevent oil leakage from the nozzle 23 when the nozzle is moved between cylinders, a spring loaded ball valve can be provided in the nozzle and designed to open under a predetermined pressure.

Figure 6A:
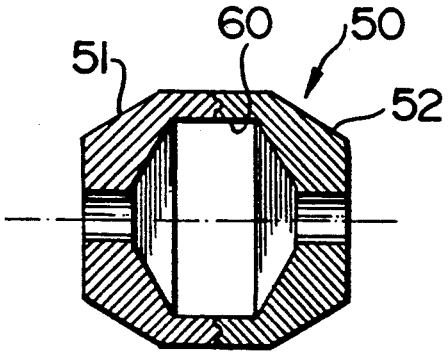
FIGS. 6A and 6B are enlarged sectional side and front views of a second embodiment of the spinner portion of the nozzle assembly.
Figure 6B:
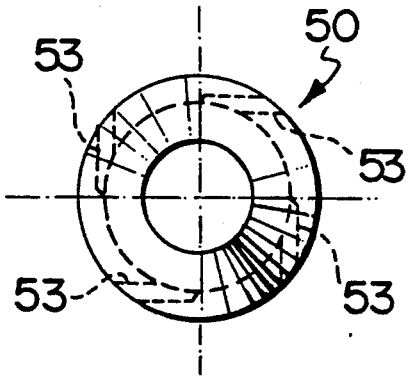

A further embodiment of the spinner portion of the invention is illustrated in FIGS. 6A and 6B. In this embodiment, the spinner portion 32 of FIGS. 4A and 4B is replaced with the spinner portion 50 which is round as viewed in FIGS. 6A and 6B. The spinner portion 50 comprises two identical halves 51, 52 each half having a portion of an annulus 60. One half has oil conveying grooves 53 ground at four locations 53. The grooves 53 are filled with pencil lead and the two halves 51, 52 are soldered or brazed together. The pencil lead is drilled out leaving the approximately .015 inch diameter tangentially oriented holes 53. The through hole 54 is then reamed to the correct size to fit extension 40 (FIG. 3).

Many further modifications beyond those set out herein will readily occur to those skilled in the art and, therefore, the embodiments described should be considered as illustrative only and not be as limiting the scope of the invention as construed in accordance with the accompanying claims.

I claim:

1. A nozzle assembly for use in the diagnosis of an engine cylinder comprising a body, a tube connected to said body for supplying oil under pressure to said body from an oil source, a spinner mounted on said body and being rotatable about an axis parallel to the axis of said cylinder when said spinner is inserted into said cylinder, the axis of said tube supplying oil to said body being at an obtuse angle to the axis of said spinner, said spinner having an annulus, oil emitting holes in said spinner extending outwardly from said spinner to emit oil onto the walls of said cylinder and to seal the rings of a piston in said cylinder, said holes communicating with said annulus, said spinner comprising at least two individual pieces joined together to form said spinner, each of said pieces containing a portion of said annulus.

2. A nozzle assembly as in claim 1 wherein said body has access holes for allowing oil access to said annulus and to said oil emitting holes in said spinner.

3. A nozzle assembly for use in the diagnosis of an engine cylinder comprising a tube, a body mounted on said tube, oil access holes in said body, a spinner mounted on said body and being formed from two pieces, each of said pieces containing a portion of an annulus, said spinner being freely rotatable relative to said body about a spinner axis, oil emitting holes in said spinner, said oil emitting holes being operable to emit oil onto the walls of said cylinder and to seal the rings of a piston in said cylinder, said oil emitting holes being offset from the axis of rotation of said spinner, said axis of rotation of said spinner being parallel to the axis of said cylinder when said oil is emitted from said spinner, the axis of at least one portion of said tube being located at an obtuse angle to said axis of said spinner, said oil access holes in said body allowing oil access to said oil emitting holes and said annulus in said spinner.

4. A method of wetting the walls of an engine cylinder with oil so as to coat the walls of said cylinder thereby to form a seal between the rings of a piston within said cylinder and said walls of said cylinder comprising inserting a nozzle assembly including a spinner through an access hole into said cylinder, providing oil under pressure to said nozzle assembly, emitting oil from said spinner of said nozzle assembly in a direction outwardly from the axis of said spinner about substantially 360 degrees while the axis of said spinner is substantially parallel to the axis of said cylinder, and measuring the compression of said cylinder following the forming of said seal.

5. A method as in claim 4 wherein said oil is emitted from an annulus within said spinner and from a plurality of holes in said spinner communicating with said annulus.

6. A method as in claim 5 wherein said oil is emitted from said spinner substantially normal to the axis of said cylinder.

7. A nozzle assembly for use in engine cylinder diagnoses comprising a body, a tube connected to said body to supply oil to said body, a spinner mounted to said body and being rotatable about an axis, said spinner having an annulus, oil emitting holes in said spinner extending outwardly from said axis and communicating with said annulus, said spinner comprising at least two individual pieces joined together to form said spinner, each of said pieces including a portion of said annulus, the axis of said tube being at an obtuse angle to the axis of said spinner such that said spinner may be inserted into said cylinder from a position on the side of said cylinder.

* * * * *